United States Patent [19]

Kozinski

[11] 4,125,576

[45] Nov. 14, 1978

[54] WATER DISTRIBUTOR TROUGH PRIMARILY FOR A WARM AIR FURNACE MOUNTED HUMIDIFIER

[75] Inventor: Richard C. Kozinski, Warren, Mich.

[73] Assignee: General Filters, Inc., Novi, Mich.

[21] Appl. No.: 834,122

[22] Filed: Sep. 19, 1977

[51] Int. Cl.[2] ..... F24F 3/14

[52] U.S. Cl. ..... 261/106; 126/113; 261/DIG. 15

[58] Field of Search ..... 261/106, 97, DIG. 4, 261/DIG. 15, DIG. 44, 103, 110; 126/113

[56] References Cited

U.S. PATENT DOCUMENTS

| | | | |
|---|---|---|---|
| 3,155,747 | 11/1964 | Perlman | 261/97 |
| 3,179,386 | 4/1965 | Liebmann | 261/97 |
| 3,193,259 | 7/1965 | Liebmann | 261/DIG. 44 |
| 3,401,681 | 9/1968 | McDuffee, Sr. | 126/113 |
| 3,515,378 | 6/1970 | Hill | 261/106 |
| 3,570,822 | 3/1971 | Peterson et al. | 261/106 |
| 3,823,926 | 7/1974 | Bracich | 261/106 |
| 3,975,470 | 8/1976 | Engel | 261/106 |

*Primary Examiner*—Frank W. Lutter
*Assistant Examiner*—Gregory N. Clements
*Attorney, Agent, or Firm*—Cullen, Sloman, Cantor, Grauer, Scott & Rutherford

[57] ABSTRACT

An air treating apparatus such as a humidifier, evaporator cooler, cooling tower or other such equipment comprising a housing provided with evaporator means and water distribution means mounted in the housing above the evaporator means to provide a substantially uniformly distributed flow of water thereto. The water distribution means includes a tray provided with an upstanding or elevated target element located between a plurality of upstanding vertical wall elements forming channels leading to apertures positioned to distribute water uniformly to the evaporator means. Water directed to the apparatus impinges with a certain velocity head on the elevated top surface of the target element from where the water while still in motion impinges upon the top edges of the internal wall elements which divide and direct the water into the channels and from where the water is distributed to the evaporator means through the apertures.

20 Claims, 9 Drawing Figures

WATER DISTRIBUTOR TROUGH PRIMARILY FOR A WARM AIR FURNACE MOUNTED HUMIDIFIER

BACKGROUND OF THE INVENTION

1. Field of the Invention

The air treating apparatus may take the form of an evaporator cooler, a cooling tower, a humidifier for use with an air system and especially adapted for installation on a forced air furnace, a free standing humidifier for use in a room, a window humidifier or other kinds of similar air-conditioning or treating apparatuses.

2. Description of the Prior Art

Apparatuses utilizing water distribution means include the structures shown in the following U.S. Pat. Nos.: 3,975,470 to Lewis O. Engel, dated Aug. 17, 1976 and assigned to the assignee of record; 2,281,799 to O. E. Quave, dated May 5, 1942; 2,809,820 to F. D. Stoops, dated Oct. 15, 1957; 3,193,259 to J. M. Liebmann, dated July 6, 1965; 3,199,846 to R. F. Durham et al, dated Aug. 10, 1965; 3,318,587 to P. E. McDuffee, dated May 9, 1967; 3,401,681 to P. E. McDuffee, Sr. et al, dated Sept. 17, 1968; 3,464,401 to W. L. McGrath, dated Sept. 2, 1969; 3,497,453 to A. Yurden, dated Feb. 24, 1970; 3,570,822 to C. D. Peterson, dated Mar. 16, 1971; and other patents cited therein.

SUMMARY OF THE PRESENT INVENTION

In the design of an air treating apparatus such as a humidifier it is important to provide for the proper distribution of water to the evaporator means so that the water may be uniformly dispersed over the entire pad. It is important for efficient operation that the distribution of water remain uniform despite errors in the mounting of the humidifier. While it is desirable that the humidifier is mounted in a level position, it has been found that this objective is not always achieved in practice and in fact many humidifiers are mounted out of level, as an example, by 15°. Thus it is important that a humidifier, while mounted substantially out of level, functions efficiently. The water distribution device of the present invention is capable of delivering or providing a uniform distribution of water to the evaporator means even when the apparatus or humidifier is not level.

It is a feature of the present invention to provide in an apparatus or humidifier a water distribution means or system comprising a tray positioned over the evaporator means and having an upstanding target element to which are secured upstanding internal wall elements or ribs which divide the tray into channels, each channel having an aperture in the bottom wall of the tray. Water directed to the apparatus impinges with a certain velocity head on the elevated top surface of the target element from where the water while still in motion impinges upon the top edges of the internal wall elements which evenly divide and direct the water into the channels and from where the water is distributed to the evaporator pad through the apertures.

It is a further feature of the present invention to provide an apparatus of the aforementioned type wherein the top surface of the target element is divided into an inner zone and an outer zone, with the top edges of the internal wall elements or ribs and the inner zone of the top surface of the target element being located in generally the same plane.

A still further feature of the present invention is to provide an apparatus of the aforementioned type wherein the inner zone of the top surface of the target element is flat and the outer zone is conical or extends downwardly and outwardly from the inner zone to the side wall of the target element.

Another feature of the present invention is to provide an air treating apparatus of the aforementioned type which is simple in construction, is economical to manufacture and is efficient in operation.

DESCRIPTION OF A PREFERRED EMBODIMENT

Figure 1:
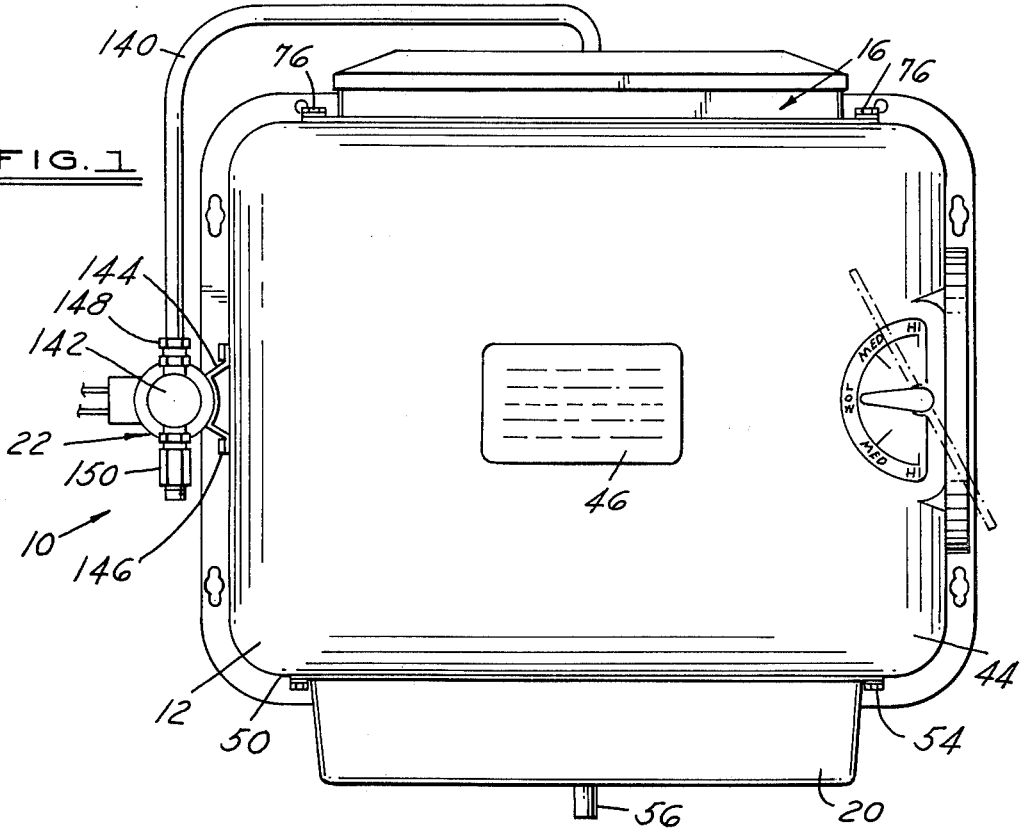
FIG. 1 is a front elevation of the humidifier or air treating apparatus.

Referring now to the drawings, the humidifier or air treating or conditioning apparatus 10 comprises a housing 12, an evaporator pad 14 within the housing 12, a water distribution trough or tray 16 removably mounted on the top of the housing 12 in an opening 18 provided therein (FIG. 7), a drain pan 20 removably secured to the bottom of the housing 12, and water supply means 22 for delivering water to the water distribution tray 16.

Figure 2:
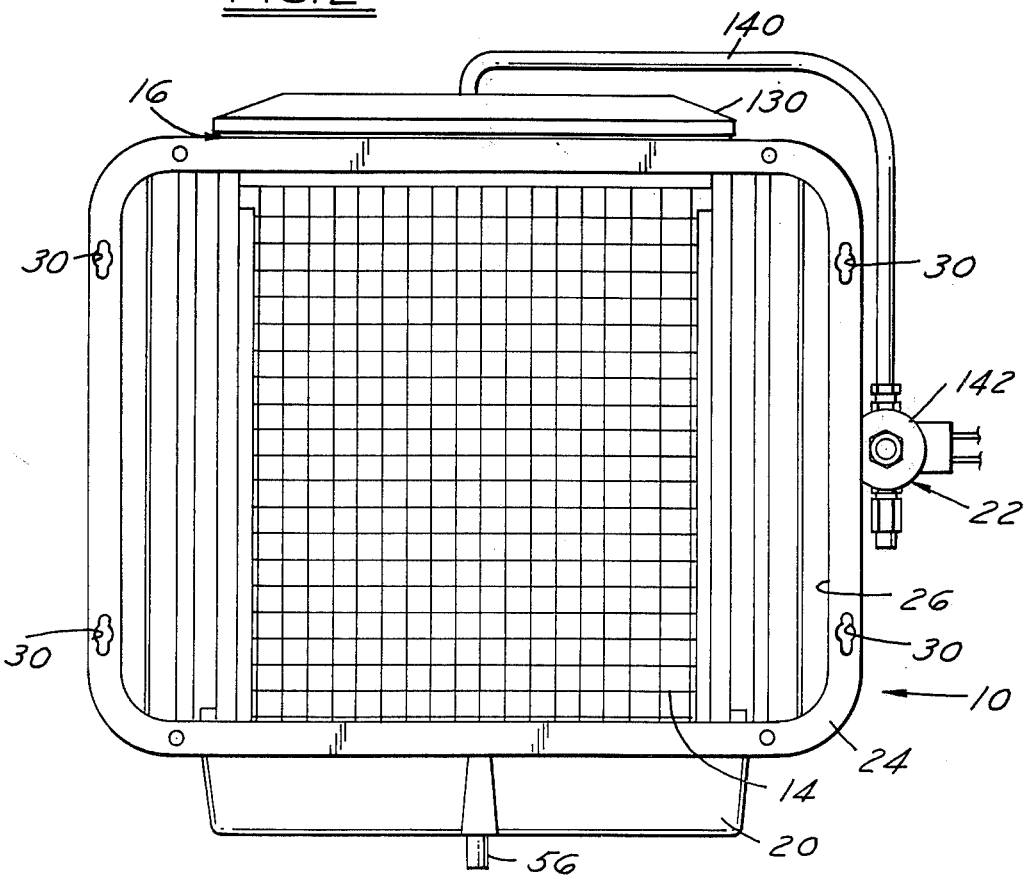
FIG. 2 is a back elevation of the humidifier.
Figures 4, 7, 8, 9:
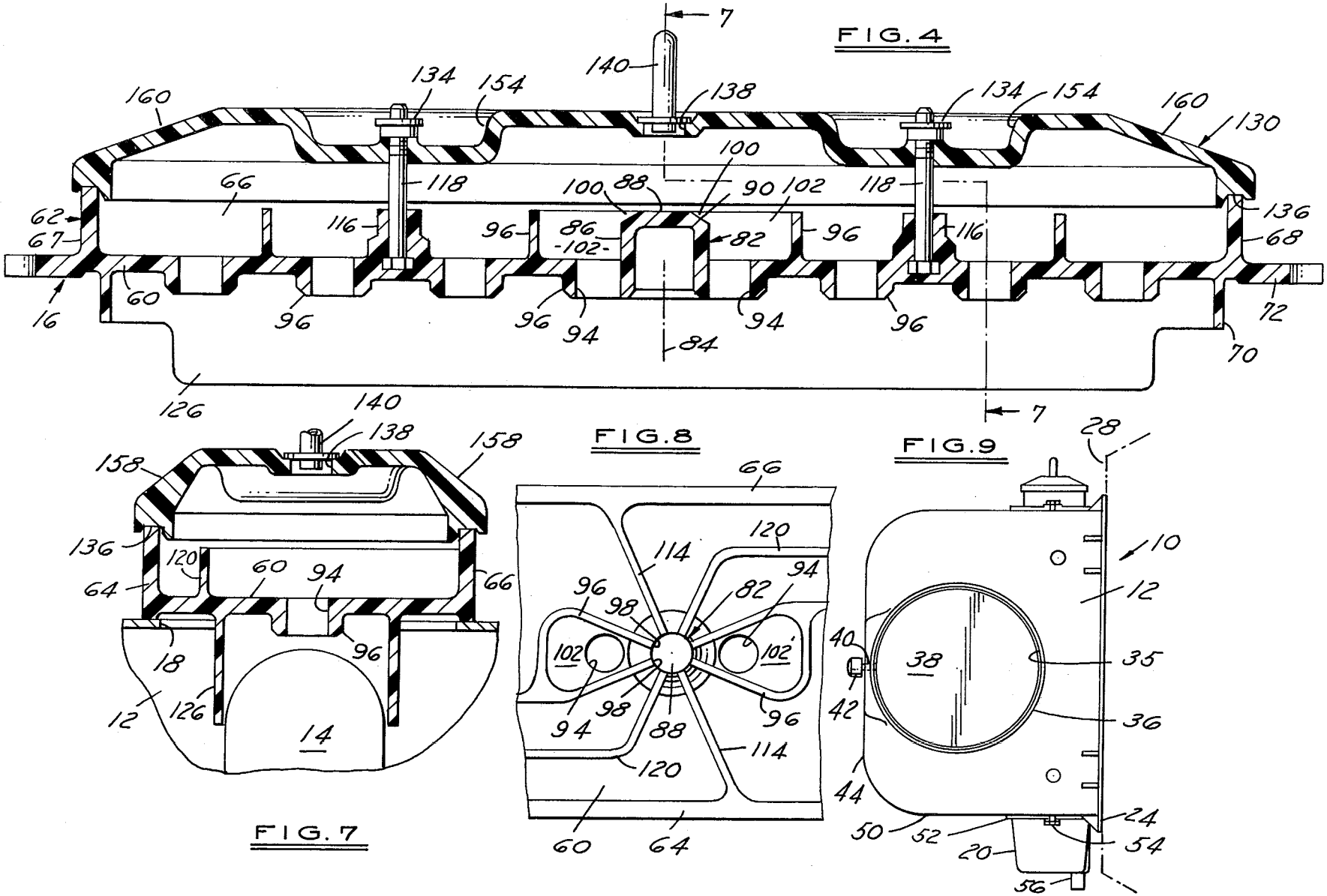
FIG. 4 is a longitudinal sectional view through the water distribution means taken on the line 4—4 of FIG. 3.
FIG. 7 is a fragmentary sectional view taken on the line 7—7 of FIG. 4.
FIG. 8 is an enlarged fragmentary plan view of the water distribution tray illustrating the spacing of the elevated ribs or wall elements with respect to the centrally located target element.
FIG. 9 is a side elevation of the humidifier.

The housing 12, as an example, is adapted to be installed on any vertical surface of an air system, particularly a forced air furnace. As shown in FIGS. 2 and 9, the flat rear wall or annular flange 24 of the housing 12 surrounds a central opening 26. The flange 24 is removably secured as by sheet metal screws, not shown, to a vertical surface 28 of a forced air furnace over an opening therein as is well known in the art. As an example, four screw openings or apertures 30 are provided in flange 24.

Figure 3:
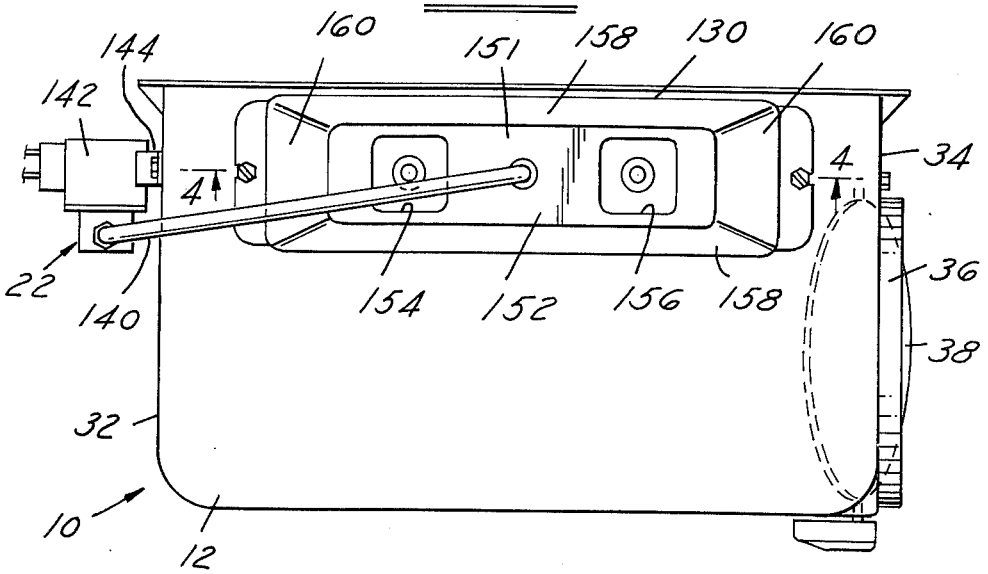
FIG. 3 is a top plan view of the humidifier.

The housing 12 is provided with parallel sides 32 and 34. The side wall 32 has the water supply means 22 mounted thereon as will be described hereinafter. The side wall 34 has a conventional circular damper opening 35 therein which is provided with an annular or tubular rim or ring 36 (FIGS. 3 and 9). The effective size of the damper opening 35 is controlled by a circular damper or closure plate 38 hinged by pins 40 journaled in opposite sides of the damper opening 35 and controlled as to its position by a control knob 42 connected to one of the pins 40 and disposed on the front wall 44 of the housing 12. A name plate 46 is mounted on the front wall 44 over an opening therein and is removable to enable the inside of the humidifier 10 to be inspected.

The evaporator pad 14 is supported upright within the housing 12 along the rear wall or flange 24. Specifically, the pad 14 is located between the opening 35 in the side wall 34 and the opening 26 in the rear wall 24. As is well known in the art, air moving through the furnace system must flow through the evaporator pad 14 to pick up moisture contained therein. The evaporator pad 14 may be formed of any suitable construction and normally is made of a foraminous material having numerous small though unobstructed passages therein which are adapted to retain water by capilarity to be picked up by air passing through it.

The evaporator pad 14 is seated upon and within the drain pan 20. The bottom wall 50 of housing 12 has a rectangular opening, not shown. The pan 20 has an annular flange 52 which is removably secured to the bottom wall 50 by threaded fasteners 54. The bottom wall of the drain pan 20 has a longitudinally extending upright rib, not shown, upon which the bottom of the evaporator pad 14 is adapted to rest as is well known in the art. Other ribs are usually provided in the drain pan 20 adjacent to the front and rear surfaces of the evaporator pad 14 to hold it vertically erect. Water drainage is permitted to pass under the pad 14 to the drain opening from whence it may be discharged through the drain pipe 56 connected thereto.

The water distribution trough or tray 16 is rectangular in form and has a horizontal bottom wall 60 and a continuous or endless vertical side wall 62 which is divided into vertical side wall portions 64 and 66 and vertical end wall portions 67 and 68. The tray 16 has a depending skirt portion 70 which fits in the complementary rectangular opening 18 provided in the top wall of the housing 12. End flanges 72 provided on tray 16 engage and rest upon the top wall of the housing 12 surrounding opening 18. Each end flange 72 has a slot 74 for receiving a threaded fastener 76 which removably secures tray 16 to the housing 12.

The tray 16 has a longitudinal axis 80. Extending vertically upwardly from the bottom wall 60 is a target element 82 of generally cylindrical configuration and having an axis 84. The axis 84 lies in a vertical plane containing the longitudinal axis 80 and thus axis 84 is perpendicular to axis 80. The target element 82 has a continuous side wall 86 and an elevated top or upper surface divided into an inner zone 88 and an outer zone 90. The inner zone 88 is flat, smooth and horizontal. The outer zone 90 which is conical extends from the inner zone 88 downwardly and outwardly to the side wall 86 at an angle of approximately 30°.

The target element 82 is located midway between the side wall portions 64, 66 and the end wall portions 67, 68 of tray 16.

Circular apertures 94 are provided or formed in the bottom wall 60 at uniformly spaced points or intervals along the center line 80 and are located in a row midway between the side wall portions 64, 66. Apertures 94 are all of the same diameter and are disposed directly over the upper edge of the evaporator pad 14 and terminate in depending tubular extensions 96 as shown in FIG. 7. The tubular extensions prevent water from clinging to the undersurface of the tray 16 and dropping on one portion only of the evaporator pad 14.

The bottom wall 60 of the tray 16 is provided with a plurality or series of upstanding internal vertical wall elements or ribs which in part define the flow channels and are connected at different points to the target element 82.

A first pair of internal wall elements or ribs 96 is provided, with each having its lower edges secured to the bottom wall 60 and the pair of end surfaces 98 abutting and secured to the side wall 86 at circumferentially spaced points as noted in FIG. 8. Each rib or element 96 has a knife edge projection 100 (FIG. 4) at an angle of 30° which fits and overlies the outer zone 90 of the target element 82 as best illustrated in FIG. 4. The knife edge projections 100 are secured to the target element 82 and thus the internal wall elements 96 form with the bottom wall 60 and the target element 82 a pair of channels 102. Each channel 102 has an aperture 94.

A plurality of additional internal wall elements or ribs are secured to the bottom wall 60 of the tray 16 to form channels 104, 104', 106, 106', 108 and 108', with each channel having an aperture 94.

Figure 5:
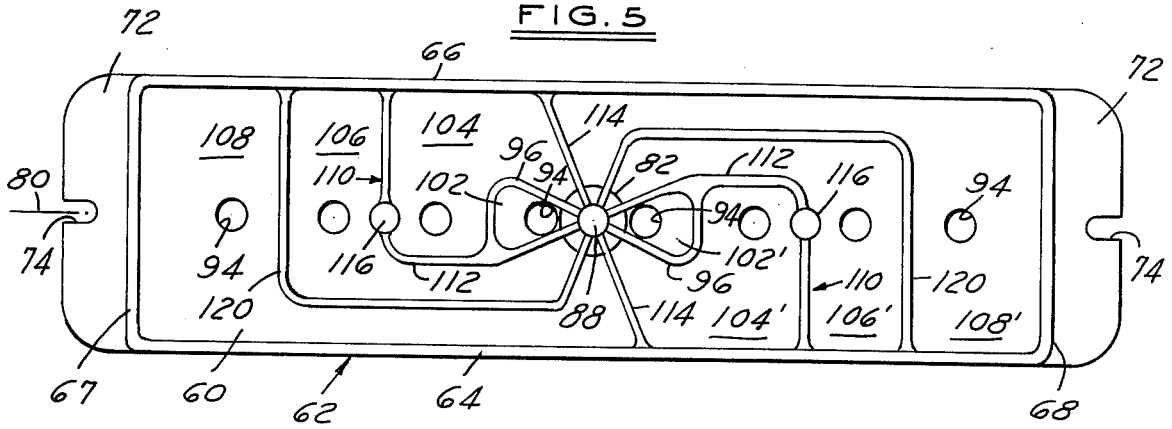
FIG. 5 is a top plan view of the water distribution tray with the cover removed.

Channels 104, 104' are each formed by a series of upstanding internal wall elements or ribs 110, 112, 114 along with wall element 96 arranged as shown in FIG. 5. One end of wall element 110 is secured to side wall 64, 66 while the other end abuts an upstanding tubular fastener embossment 116 which carries a threaded fastener 118 (FIG. 4). Embossments 116 are integrally formed with the tray and extends upwardly from the bottom wall 60. Each wall element or rib 112 has one end surface secured to embossment 116 and the other end surface connected to internal wall element 96 as shown in FIG. 5. Each wall element or rib 114 is secured on one end surface to side wall portion 64, 66 and on the other end surface to the target element 82 as shown in FIG. 5.

Channels 106, 106' are each formed on one side by the aforementioned wall elements 110, 112 and 96 and on the other side by an internal wall element or rib 120 which is secured on one end to side wall portion 64, 66 and on the other end surface to the target element as shown in FIG. 5.

Channels 108, 108' are each formed on one side by the aforementioned wall element 120 and portions of the side wall portions 64, 66 and end wall portions 67 and 68 of the tray as shown in FIG. 5.

As an example, in certain constructions the heights of the internal vertical wall elements or ribs are the same, with the upper edges thereof lying in a plane containing the inner zone 88 of the top surface of the target element 82. The height of each of the internal wall elements is slightly less than the height of the side and end wall portions 64, 66, 67 and 68 of the tray 16.

Each of the internal wall elements abutting the target element 82 (FIG. 8) has a knife edge projection like projection 100 so as to conform on the slanted side thereof to the configuration of the outer zone 90 of the top surface of the target element 82 and to provide a flat surface on the upper edge thereof which lies in the same plane as the inner zone 88 of the top surface of the target element 82.

Figure 6:
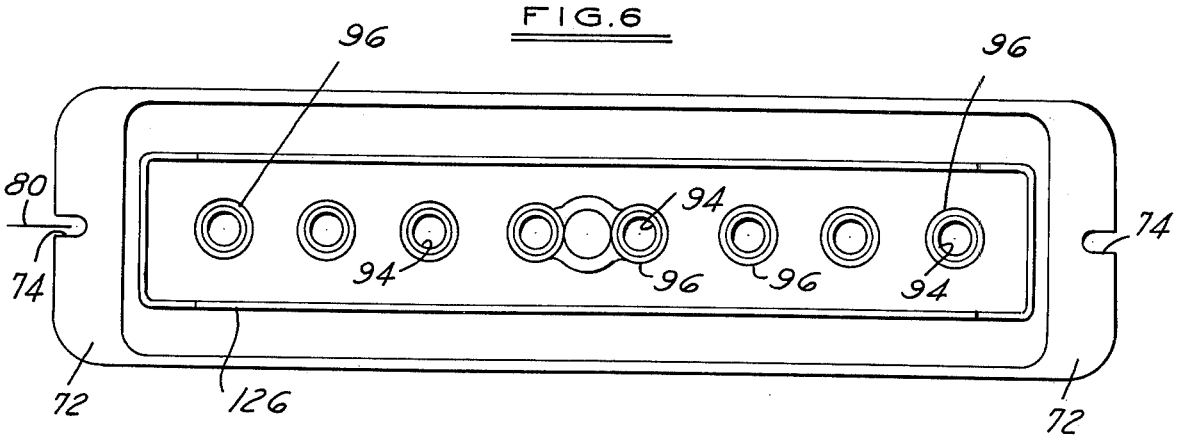
FIG. 6 is a bottom view of the tray.

The water distribution tray has a depending rectangular skirt or shroud 126 (FIGS. 6 and 7) which surrounds the tubular extensions 96 of the apertures 94 and also surrounds the upper edge portion of the evaporator pad 14. This shroud or skirt 126 stabilizes the evaporator pad 14 and holds it upright and also prevents the water dripping from the apertures 94 from being deflected away from the evaporator pad 14 by the air flowing through the housing 12.

The tray 16 is of generally the same size and shape as the drain pan 20, and the opening 18 in the top wall of the housing is generally the same size and shape as the opening provided in the bottom wall 50 of the housing 12. Accordingly, the tray 16 and drain pan 20 are interchangeable as is well known in the art.

The tray has a cover or lid 130 which is rectangular in form and has an annular sealing rib 136 extending around its periphery for contact with the side and end wall portions 64, 66, 67 and 68 of the tray 16. The cover 130 is removably secured to the tray 16 by any suitable means, shown in FIG. 4 as comprising nuts 134 threaded on the upright posts of fasteners 118. The top surface of the tray 16 has a central aperture 138 located above and spaced from the target element 82. A water supply tube or hose 140 has its discharge end secured in the aperture 138 to direct water onto the target element 82. The tube 140 is connected to a suitable pump or similar means (not shown) for supplying water under pressure. The flow of water to the tube 140 is controlled by a solenoid valve 142 carried by a bracket 144 secured to the side wall 32 of the housing 12 by fasteners 146. A first fitting 148 connects the tube 140 to the valve 142 and a second fitting 150 is for connecting the solenoid valve 142 to a water pump or the like. The solenoid valve 142 may be connected with the blower circuit of the furnace to as to open when the furnace blower is on and close when the blower is off. A humidistat may be connected in series with the solenoid valve 142 to provide automatic control of relative humidity in the humidified air space.

Preferably the upper surface 151 of the cover 130 has a flat center portion 152 which is downwardly dished in two zones or areas as indicated by the numerals 154, 156 (FIGS. 3 and 4). The side and end portions of the cover 130 slope downwardly and outwardly as indicated by the numerals 158, 160 respectively.

In use, the humidifier is mounted as shown in FIG. 7 with care so that the bottom of the tray 16 is horizontal or as near horizontal as possible to provide for an equal distribution of water through the various apertures 94. However, because of the unique construction of the target element 82 and the channels leading therefrom to the various apertures 94, slight departure from horizontal, as an example, up to 15°, will not particularly affect the uniform distribution of water to the evaporator pad 14. The target element 82 is midway between the side and end wall portions of the tray. Thus even if the tray 16 is tipped so that one end or one side is a certain distance below the other end or side respectively, the water striking the elevated inner zone 88 of the target element 82 will still spread radially outwardly and will thereafter be divided by the plurality of internal wall elements or ribs into the channels. The water impinges with a certain velocity head on the inner zone 88 of the target element 82 from where the water while still in motion impinges upon the top edges of the internal wall elements 96, 114 and 120 which divides and directs the water into the channels 102, 102', 104, 104', 106, 106', 108 and 108' and from where the water in motion is distributed to the evaporator pad 14 through the apertures 94.

Sometimes because of the location of the furnace piping or plumbing, it is necessary or desirable to turn the humidifier housing 12 upside down so that the plumbing may be on the right and the air duct on the left rather than in the position shown in FIG. 1. In that event, and because the tray 16 and drain pan 20 are interchangeable, these two parts may be removed and interchanged, securing the tray 16 to the bottom wall 50 of the housing 12 which is now at the top, and the drain pan 20 to the top wall of the housing 12 which is now at the bottom.

The tray 16 and cover 130 may, as an example, be made from thermo setting or thermo plastic materials or even from metal. The channels provide large water passageways which are easy to clean and maintain.

The term "evaporator means" includes humidifier evaporator pads, wood slats used in cooling towers and other types of evaporator articles used in air-conditioning or treating apparatuses.

What is claimed is:

1. An air treating apparatus comprising a housing, evaporator means mounted in said housing, water distribution means disposed above said evaporator means for providing a substantially uniformly distributed flow of water to said evaporator means, said water distribution means comprising a tray having a bottom wall and an upright continuous wall, a target element extending upwardly from the bottom wall of said tray, said target element having a side wall and being provided on the upper end thereof with a top surface divided into an inner zone and an outer zone, a first pair of internal vertical wall elements extending upwardly from the bottom wall of said tray and located on opposite sides of said target element, each of said first pair of internal wall elements having a pair of end surfaces which abut and are secured to said target element and define a channel, a plurality of additional internal wall elements on opposite sides of said target element, each of said additional internal wall elements having a pair of end surfaces which abut and are secured on one end surface to said target element and on the other end surface to said continuous wall of said tray and define a channel, a plurality of longitudinally spaced apertures formed in the bottom wall of said tray, one aperture being provided for each channel, the top edges of said internal wall elements intersecting said target element, whereby water directed to the apparatus impinges with a certain velocity head on the top surface of said target element from where the water flows and while still in motion impinges upon the top edges of said internal wall elements which divides and directs the flowing water into said channels and from where the water is distributed to the evaporator means through said apertures.

2. The air treating apparatus defined in claim 1 wherein said tray is of rectangular configuration and said upright continuous wall includes side and end wall portions, said target element being centrally located between the side and end wall portions of said tray.

3. The air treating apparatus defined in claim 2 wherein said apertures are formed in the bottom wall of said tray in a continuous row located midway between said side wall portions from one end wall portion to the other.

4. The air treating apparatus defined in claim 1 wherein said inner zone of the top surface of said target element is flat.

5. The air treating apparatus defined in claim 1 wherein the top edges of said internal wall elements and the inner zone of the top surface of said target element are located in generally the same plane.

6. The air treating apparatus defined in claim 5 wherein said outer zone of the top surface of said target element is conical.

7. The air treating apparatus defined in claim 5 wherein said outer zone of the top surface of said target element extends downwardly and outwardly from said inner zone to the side wall of said target element.

8. The air treating apparatus defined in claim 7 wherein said outer zone of the top surface of said target element extends downwardly at an angle of approximately 30°.

9. The air treating apparatus defined in claim 1 wherein said apertures have tubular extensions projecting downwardly beneath the lower surface of said bottom wall.

10. The air treating apparatus defined in claim 1, wherein said tray has a skirt alongside said apertures extending downwardly beneath said bottom wall in overlapping relation to the upper portion of said evaporator pad.

11. The air treating apparatus defined in claim 1, wherein a cover is secured over said tray having a water fitting extending therethrough above said target element to supply water to said tray.

12. The air treating apparatus defined in claim 1 wherein means are provided for removably securing said tray to said housing comprising a mounting flange on said tray, a mounting flange on said housing engaging said tray mounting flange, and threaded fastening means for securing said flanges together.

13. A humidifier adapted to be connected to an air system comprising a housing, an evaporator pad mounted in said housing, water distribution means disposed above said evaporator pad for providing a substantially uniformly distributed flow of water to said evaporator pad, said water distribution means comprising an elongated tray having a bottom wall and an upright continuous wall including side and end wall portions, a target element located centrally between said side and end wall portions and extending upwardly from the bottom wall of said tray, said target element having a side wall and being provided on the upper end thereof with a top surface divided into an inner zone and an outer zone, a first pair of internal vertical wall elements extending upwardly from the bottom wall of said tray and located on opposite sides of said target element, each of said first pair of internal wall elements having a pair of end surfaces which abut the side wall of and are secured to said target element and define a channel, a plurality of additional internal wall elements on opposite sides of said target element, each of said additional internal wall elements having a pair of end surfaces which abut the side wall of and are secured on one end surface to said target element and on the other end surface to one of said side wall portions of said tray and define a channel, a plurality of longitudinally spaced apertures formed in the bottom wall of said tray, one aperture being provided for each channel, the top edges of said internal wall elements and the inner zone of said target element being located in generally the same plane, whereby water directed to the apparatus impinges with a certain velocity head on the top surface of said target element from where the water flows and while still in motion impinges upon the top edges of said internal wall elements which divides and directs the flowing water into said channels and from where the water is distributed to the evaporator pad through said apertures.

14. The humidifier defined in claim 13 wherein said inner zone of the top surface of said target element is flat.

15. The humidifier defined in claim 13 wherein said outer zone of the top surface of said target element is conical.

16. The humidifier defined in claim 13 wherein said outer zone of the top surface of said target element extends downwardly and outwardly from said inner zone to the side wall of said target element.

17. The humidifier defined in claim 16 wherein said outer zone of the top surface of said target element extends downwardly at an angle of approximately 30°.

18. The humidifier defined in claim 13 wherein said apertures are formed in the bottom wall of said tray in a continuous row located midway between said side wall portions from one end wall portion to the other.

19. The humidifier defined in claim 18 wherein said apertures have tubular extensions projecting downwardly beneath the lower surface of said bottom wall.

20. The humidifier defined in claim 19 wherein said tray has a skirt alongside the tubular extensions of said apertures, said skirt extending downwardly beneath said bottom wall in overlapping relation to the upper portion of said evaporator pad.

* * * * *